US010274871B2

(12) United States Patent
Ron et al.

(10) Patent No.: US 10,274,871 B2
(45) Date of Patent: Apr. 30, 2019

(54) ELECTROPHOTOGRAPHIC PRINTING

(71) Applicant: HP Indigo B.V., Amstelveen (NL)

(72) Inventors: Hannoch Ron, Kadima (IL); Yaron Hershman, Gedera (IL); Gleb Romantcov, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/754,510

(22) PCT Filed: Oct. 28, 2015

(86) PCT No.: PCT/EP2015/075030
§ 371 (c)(1),
(2) Date: Feb. 22, 2018

(87) PCT Pub. No.: WO2017/071751
PCT Pub. Date: May 4, 2017

(65) Prior Publication Data
US 2018/0217524 A1 Aug. 2, 2018

(51) Int. Cl.
*G03G 15/10* (2006.01)

(52) U.S. Cl.
CPC ..... *G03G 15/101* (2013.01)

(58) Field of Classification Search
CPC ..... B41J 3/546
USPC ..... 399/2, 6
See application file for complete search history.

(56) References Cited

U.S. PATENT DOCUMENTS 5,373,350 A 12/1994 Taylor et al.
5,414,498 A 5/1995 Buchan et al.
5,561,500 A * 10/1996 Ohzeki ..... B41J 3/546 347/104
5,781,823 A * 7/1998 Isobe ..... B41J 3/44 347/3
6,376,147 B1 * 4/2002 Bonsignore ..... G03G 9/122 430/114
6,725,770 B2 * 4/2004 Maeda ..... B41J 3/546 101/118
6,839,524 B2 * 1/2005 Yamaguchi ..... G03G 21/043 347/3
7,016,621 B1 3/2006 Ng
7,274,883 B2 * 9/2007 Evans ..... B41J 3/546 347/2
7,903,985 B2 * 3/2011 Yang ..... G03G 15/10 347/2
8,190,076 B2 5/2012 Omata
(Continued)

FOREIGN PATENT DOCUMENTS

GB 2307094 5/1997
WO WO-2007/130069 11/2007
WO WO-2014/187497 11/2014

OTHER PUBLICATIONS

Anonymous: "Toner—Wikipedia", XP055284999, Retrieved from the Internet Jun. 30, 2016: URL:https://de.wikipedia.org/w/index.php?title=Toner&oldid=146265320.
(Continued)

*Primary Examiner* — Walter L Lindsay, Jr.
*Assistant Examiner* — Arlene Heredia
(74) *Attorney, Agent, or Firm* — Dierker & Kavanaugh PC

(57) ABSTRACT

Herein is described an electrophotographic printing process in which a liquid electrophotographic ink image and a dry electrophotographic toner image may be printed on a print substrate.

15 Claims, 4 Drawing Sheets

(56) References Cited

U.S. PATENT DOCUMENTS

| | | | | |
|---|---|---|---|---|
| 9,031,469 | B2 | 5/2015 | Iwasaki et al. | |
| 2002/0051919 | A1* | 5/2002 | Berkes | G03G 5/047 430/59.1 |
| 2003/0007814 | A1* | 1/2003 | Richards | G03G 13/08 399/341 |
| 2012/0243008 | A1 | 9/2012 | Chatow et al. | |
| 2013/0287456 | A1 | 10/2013 | Kiyama et al. | |
| 2013/0288175 | A1 | 10/2013 | Chun et al. | |

OTHER PUBLICATIONS

Iida et al. "Digital Fabrication Using High-resolution Liquid Toner Electrophotography", Journal of Imaging Science and Technology, Abstract, vol. 51, No. 5 (2007) 1 pg.

International Search Report and Written Opinion for International Application No. PCT/EP2015/075030, dated Jul. 25, 2016, 15 pages.

Anonymous: "Toner—Wikipedia", Retrieved from the Internet Feb. 8, 2018: URL:https://en.wikipedia.org/w/index.php?title=Toner&oldid=823712933.

* cited by examiner

ELECTROPHOTOGRAPHIC PRINTING

BACKGROUND

Electrophotographic printing, or electrostatic printing, is one method by which images or information can be printed onto substrates such as paper or plastic. The printing processes may involve creating an image on a photoconductive surface, applying an ink or toner having charged particles to the photoconductive surface, such that they selectively bind to the image, and then transferring the charged particles in the form of the image to a print substrate.

DETAILED DESCRIPTION

Figure 1A:
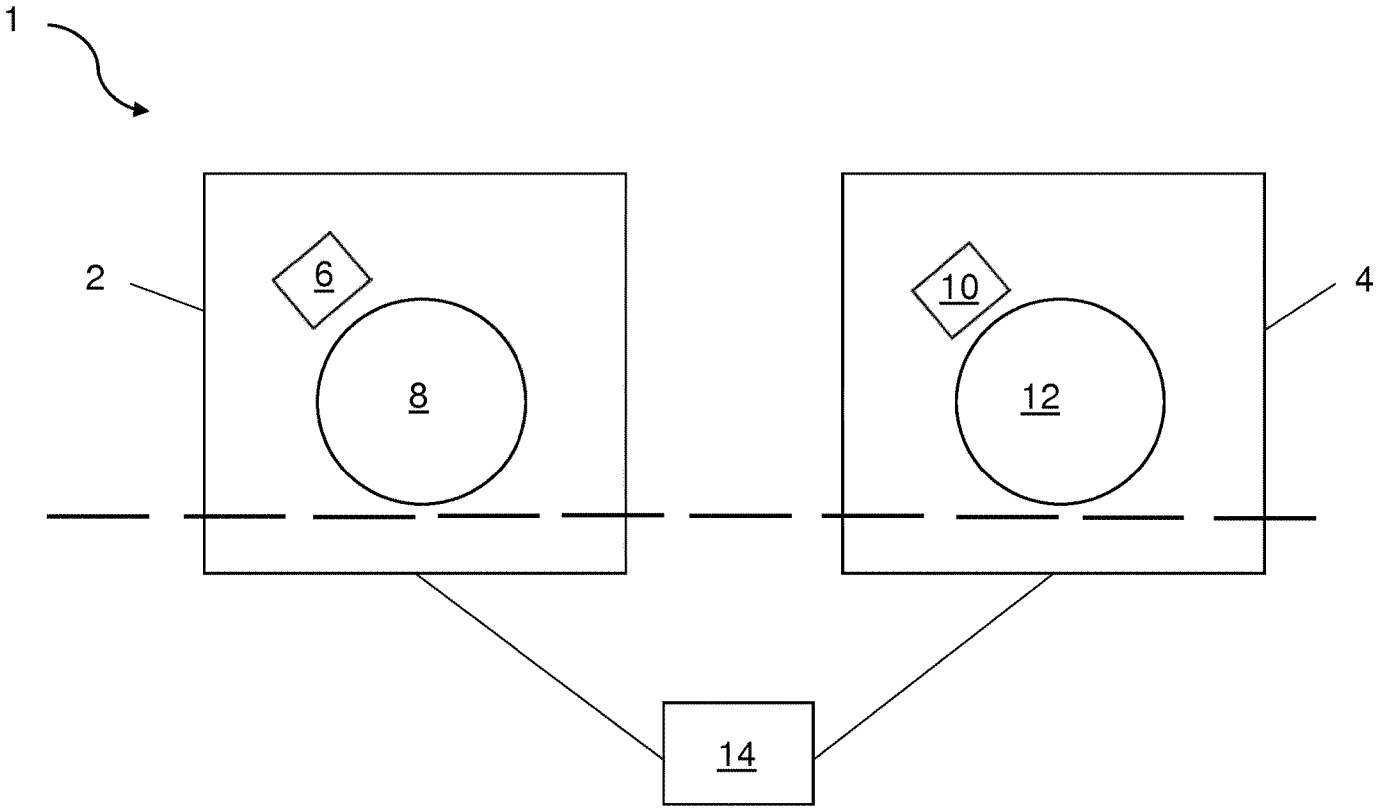
FIG. 1*a* is a schematic diagram of an electrophotographic printing apparatus.

Before the present disclosure is disclosed and described, it is to be understood that this disclosure is not restricted to the particular process features and materials disclosed herein because such process features and materials may vary somewhat.

It is noted that, as used in this specification and the appended claims, the singular forms "a," "an," and "the" include plural referents unless the context clearly dictates otherwise.

As used herein, "carrier fluid", "carrier liquid," "carrier," or "carrier vehicle" refers to the fluid in which pigment particles, colorant, charge directors and other additives can be dispersed to form a liquid electrostatic composition or electrophotographic composition. The carrier liquids may include a mixture of a variety of different agents, such as surfactants, co-solvents, viscosity modifiers, and/or other possible ingredients.

As used herein, "electrostatic ink composition" or "liquid electrophotographic composition" generally refers to an ink composition that is suitable for use in an electrostatic printing process, sometimes termed an electrophotographic printing process. It may comprise pigment particles, which may comprise a thermoplastic resin.

As used herein, "electrostatic powder toner", "electrophotographic powder toner", "dry electrostatic toner", or "dry electrophotographic toner" generally refers to a toner composition that is suitable for use in a dry electrostatic printing process, sometimes termed a dry electrophotographic printing process. It may comprise particles comprising a thermoplastic resin.

As used herein, "pigment" generally includes pigment colorants, magnetic particles, aluminas, silicas, and/or other ceramics or organo-metallics, whether or not such particulates impart color. Thus, though the present description primarily exemplifies the use of pigment colorants, the term "pigment" can be used more generally to describe not just pigment colorants, but other pigments such as organometallics, ferrites, ceramics, etc.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrostatic composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise. In some examples, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the electrostatic composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly or indirectly via an intermediate transfer member to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above.

"Liquid electrophotographic printing" is a specific type of electrophotographic printing where a liquid composition is employed in the electrophotographic process rather than a powder toner. An electrostatic printing process may involve subjecting the electrostatic composition to an electric field, e.g. an electric field having a field gradient of 50-400V/μm, or more, in some examples 600-900V/μm, or more. As used herein, "liquid electrophotographically printing" is used to refer to a process in which liquid electrophotographic printing is employed to print a liquid electrophotographic ink onto a print substrate.

As used herein, "dry electrophotographic printing" (or "dry electrostatic printing") is used to refer to a type of electrophotographic printing where a powder toner is employed in the electrophotographic printing process. As used herein, "dry electrophotographically printing" is used to refer to a process in which dry electrophotographic printing is employed to print a dry electrophotographic toner onto a print substrate.

As used herein, the term "about" is used to provide flexibility to a numerical range endpoint by providing that a given value may be a little above or a little below the endpoint to allow for variation in test methods or apparatus. The degree of flexibility of this term can be dictated by the particular variable.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the end points of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used herein, wt % values are to be taken as referring to a weight-for-weight (w/w) percentage of solids in the ink composition, and not including the weight of any carrier fluid present.

Unless otherwise stated, any feature described herein can be combined with any aspect or any other feature described herein.

Described herein is an electrophotographic printing process. The process may comprise:

- providing a liquid electrophotographic (LEP) ink comprising a first resin, a pigment and a carrier liquid;
- providing a dry electrophotographic (DEP) toner comprising a second resin;
- providing a print substrate;
- liquid electrophotographically printing a LEP ink image on the print substrate; and
- dry electrophotographically printing a DEP toner image on the print substrate.

Also described herein is an electrophotographic printing apparatus to print a DEP toner image and a LEP ink image on a print substrate. The apparatus may comprise:

- a LEP printing station comprising a reservoir for receiving a LEP ink and a first photoconductive member having a surface on which a first latent image can be created;
- a DEP printing station comprising a reservoir for receiving a DEP toner and a second photoconductive member having a surface on which a second latent image can be created; and
- a controller in communication with the LEP printing station and the DEP printing station to control the position of the LEP ink image and the DEP toner image on the print substrate with respect to one another.

Also described herein is a printed substrate. The printed substrate may comprise:

- a print substrate;
- a liquid electrophotographically printed ink layer comprising a first resin and a pigment; and
- a dry electrophotographically printed toner layer comprising a second resin.

Liquid Electrophotographic (LEP) Ink Composition

The liquid electrophotographic ink (also referred to herein as a LEP composition) comprises a first resin (also referred to below as a polymer resin). The LEP ink (also referred to herein as a LEP composition) useful in the methods described herein may comprise a colorant or pigment, a first resin (also referred to below as a polymer resin) and a carrier fluid or liquid.

The LEP ink may further comprise an additive such as a charge director, charge adjuvant, surfactant, viscosity modifier, emulsifier and the like.

In some examples, the LEP ink comprises ink particles comprising a first resin, the ink particles dispersed in a carrier liquid. In some examples, the ink particles comprise the first resin and a colorant or pigment.

In some examples, the ink particles may have a median particle size or $d_{50}$ in the range of about 2 μm to about 8 μm, for example 5 μm to about 7 μm.

Unless otherwise stated, the particle size of the ink particle is determined using laser diffraction on a Malvern Mastersizer 2000 according to the standard procedure as described in the operating manual.

Pigment

The liquid electrophotographic (LEP) ink composition may comprise a pigment or colorant. The pigment may be any pigment or colorant compatible with the liquid carrier and useful for electrophotographic printing. For example, the pigment may be present as pigment particles, or may comprise a resin (in addition to the polymer resin (first resin) described herein) and a pigment. In some examples, the pigment is selected from a cyan pigment, a magenta pigment, a yellow pigment and a black pigment. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM® YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE® YELLOW SGT, IRGALITE® RUBINE 4BL, MONASTRAL® MAGENTA, MONASTRAL® SCARLET, MONASTRAL® VIOLET, MONAS- TRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200. Where the pigment is a white pigment particle, the pigment particle may be selected from the group consisting of $TiO_2$, calcium carbonate, zinc oxide, and mixtures thereof. In some examples the white pigment particle may comprise an alumina-$TiO_2$ pigment.

In some examples the pigment may be a metallic pigment, e.g. a metal, for example a metal in elemental form or an alloy of two or more metals. A metallic pigment may comprise a metal selected from aluminium, tin, a transition metal (e.g. zinc, copper, silver, gold, nickel, palladium, platinum, and iron), and alloys (including, for example, brass, bronze, steel and chromium) of any one of more thereof. In some examples a metallic pigment may have any three-dimensional shape. In some examples, a metallic pigment is in the form selected from a flake, a sphere, a rod, or approximations thereof.

The colorant or pigment particle may be present in the LEP ink in an amount of from 10 wt % to 80 wt % of the total amount of resin and pigment, in some examples 15 wt % to 80 wt %, in some examples 15 wt % to 60 wt %, in some examples 15 wt % to 50 wt %, in some examples 15 wt % to 40 wt %, in some examples 15 wt % to 30 wt % of the total amount of resin and colorant. In some examples, the colorant or pigment particle may be present in the LEP ink in an amount of at least 50 wt % of the total amount of resin and colorant or pigment, for example at least 55 wt % of the total amount of resin and colorant or pigment.

First Resin

The LEP ink includes a first resin, which may be a thermoplastic resin. A thermoplastic polymer is sometimes referred to as a thermoplastic resin. The first resin may coat the colourant or pigment. In some examples, the first resin of the LEP ink composition is different from the second resin of the dry electrophotographic toner.

The first resin may include a polymer. In some examples, the polymer of the first resin may be selected from ethylene acrylic acid copolymers; ethylene methacrylic acid copolymers; ethylene vinyl acetate copolymers; copolymers of ethylene (e.g. 80 wt % to 99.9 wt %), and alkyl (e.g. C1 to C5) ester of methacrylic or acrylic acid (e.g. 0.1 wt % to 20 wt %); copolymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g. copolymer of acrylic or methacrylic acid and at least one alkyl ester of acrylic or methacrylic acid wherein alkyl is, in some examples, from 1 to about 20 carbon atoms, such as methyl methacrylate (e.g. 50 wt % to 90 wt %)/methacrylic acid (e.g. 0 wt % to 20 wt %)/ethylhexylacrylate (e.g. 10 wt % to 50 wt %)); ethylene-acrylate terpolymers:ethylene-acrylic esters-maleic anhydride (MAH) or glycidyl methacrylate (GMA) terpolymers; ethylene-acrylic acid ionomers and combinations thereof.

In some examples, the first resin comprises a copolymer of an alkylene monomer and an acrylic acid or methacrylic acid monomer.

In some examples, the polymer is a copolymer of an alkylene monomer and a monomer having an acid side group. In some examples the alkylene monomer is an ethylene or a propylene monomer. In some examples, the monomer having an acid side group is an acrylic acid monomer or a methacrylic acid monomer.

The first resin may comprise a polymer having acidic side groups. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures, for example using the procedure described in ASTM D1386.

The first resin may comprise a polymer, in some examples a polymer having acidic side groups, that has a melt flow rate of less than about 60 g/10 minutes, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of in some examples about 50 g/10 minutes to about 120 g/10 minutes, in some examples 60 g/10 minutes to about 100 g/10 minutes.

In some examples, the polymer having acid side groups constitutes at least 50 wt. % of the resin, in some examples at least 60 wt. % in some examples at least 80 wt. %, in some examples at least 90 wt. %. In some examples, the polymer having acid side groups has a melt flow rate of greater than about 200 g/10 minutes, in some examples a melt flow rate of greater than about 200 g/10 minutes and up to about 500 g/10 minutes, and constitutes at least 50 wt. % of the resin, in some examples at least 60 wt. % in some examples at least 80 wt. %, in some examples at least 90 wt. %.

The melt flow rate can be measured using standard procedures, for example as described in ASTM D1238.

The acidic side groups may be in free acid form or may be in the form of an anion and associated with a counterion, e.g. a metal counterion, e.g. a metal selected from the alkali metals, such as lithium, sodium and potassium, alkali earth metals, such as magnesium or calcium, and transition metals, such as zinc. The polymer having acidic sides groups can be selected from resins such as copolymers of ethylene and an ethylenically unsaturated acid of either acrylic acid or methacrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The polymer comprising acidic side groups can be a copolymer of ethylene and an ethylenically unsaturated acid of either acrylic or methacrylic acid, where the ethylenically unsaturated acid of either acrylic or methacrylic acid constitute from 5 wt % to about 25 wt % of the copolymer, in some examples from 10 wt % to about 20 wt % of the copolymer.

The first resin may comprise two different polymers having acidic side groups. The two polymers having acidic side groups may have different acidities, which may fall within the ranges mentioned above. The first resin may comprise a first polymer having acidic side groups that has an acidity of from 50 mg KOH/g to 110 mg KOH/g and a second polymer having acidic side groups that has an acidity of 110 mg KOH/g to 130 mg KOH/g.

The first resin may comprise two different polymers having acidic side groups: a first polymer having acidic side groups that has a melt flow rate of about 10 g/10 minutes to about 50 g/10 minutes and an acidity of from 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The first resin may comprise two different polymers having acidic side groups: a first polymer that is a copolymer of ethylene (e.g. 92 to 85 wt %, in some examples about 89 wt %) and acrylic or methacrylic acid (e.g. 8 to 15 wt %, in some examples about 11 wt %) having a melt flow rate of 80 to 110 g/10 minutes and a second polymer that is a copolymer of ethylene (e.g. about 80 to 92 wt %, in some examples about 85 wt %) and acrylic acid (e.g. about 18 to 12 wt %, in some examples about 15 wt %), having a melt viscosity lower than that of the first polymer, the second polymer for example having a melt viscosity of 15000 poise or less, in some examples a melt viscosity of 10000 poise or less, in some examples 1000 poise or less, in some examples 100 poise or less, in some examples 50 poise or less, in some examples 10 poise or less. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

In any of the first resins mentioned above, the ratio of the first polymer having acidic side groups to the second polymer having acidic side groups can be from about 10:1 to about 2:1. In another example, the ratio can be from about 6:1 to about 3:1, in some examples about 4:1.

The first resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The first resin may comprise a first polymer having a melt viscosity of 15000 poise or more, in some examples 20000 poise or more, in some examples 50000 poise or more, in some examples 70000 poise or more; and in some examples, the first resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The first resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), and example of the second polymer is Nucrel 699 (from DuPont), and an example of the third polymer is AC-5120 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the first resin comprises a single type of resin polymer, the resin polymer (excluding any other components of the LEP ink) may have a melt viscosity of 6000 poise or more, in some examples a melt viscosity of 8000 poise or more, in some examples a melt viscosity of 10000 poise or more, in some examples a melt viscosity of 12000 poise or more. If the first resin comprises a plurality of polymers all the polymers of the first resin may together form a mixture (excluding any other components of the LEP ink) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The first resin may comprise two different polymers having acidic side groups that are selected from copolymers of ethylene and an ethylenically unsaturated acid of either methacrylic acid or acrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The first resin may comprise (i) a first polymer that is a copolymer of ethylene and an ethylenically unsaturated acid of either acrylic acid and methacrylic acid, wherein the ethylenically unsaturated acid of either acrylic or methacrylic acid constitutes from 8 wt % to about 16 wt % of the copolymer, in some examples 10 wt % to 16 wt % of the copolymer; and (ii) a second polymer that is a copolymer of ethylene and an ethylenically unsaturated acid of either acrylic acid and methacrylic acid, wherein the ethylenically unsaturated acid of either acrylic or methacrylic acid constitutes from 12 wt % to about 30 wt % of the copolymer, in some examples from 14 wt % to about 20 wt % of the copolymer, in some examples from 16 wt % to about 20 wt % of the copolymer in some examples from 17 wt % to 19 wt % of the copolymer.

In some examples, the first resin essentially consists of a copolymer of ethylene and methacrylic acid. In some examples the methacrylic acid of the copolymer of ethylene and methacrylic acid constitutes about 8 wt % to about 12 wt % of the copolymer, in some examples about 9 wt % to about 11 wt % of the copolymer, in some examples about 10 wt. % of the copolymer.

In an example, the first resin constitutes about 5 to 90%, in some examples about 5 to 80%, by weight of the solids of the LEP ink. In another example, the resin constitutes about 10 to 60% by weight of the solids of the LEP ink. In another example, the first resin constitutes about 15 to 40% by weight of the solids of the LEP ink. In another example, the first resin constitutes about 60 to 95% by weight, in some examples from 80 to 90% by weight, of the solids of the LEP ink.

The first resin may comprise a polymer having acidic side groups, as described above (which may be free of ester side groups), and a polymer having ester side groups. The polymer having ester side groups is, in some examples, a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, for example, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1 to 50% by weight of the co-polymer, in some examples 5 to 40% by weight, in some examples 5 to 20% by weight of the copolymer, in some examples 5 to 15% by weight of the copolymer. The second monomer may constitute 1 to 50% by weight of the co-polymer, in some examples 5 to 40% by weight of the co-polymer, in some examples 5 to 20% by weight of the co-polymer, in some examples 5 to 15% by weight of the copolymer. In an example, the first monomer constitutes 5 to 40% by weight of the co-polymer, the second monomer constitutes 5 to 40% by weight of the co-polymer, and with the third monomer constituting the remaining weight of the copolymer. In an example, the first monomer constitutes 5 to 15% by weight of the co-polymer, the second monomer constitutes 5 to 15% by weight of the co-polymer, with the third monomer constituting the remaining weight of the copolymer. In an example, the first monomer constitutes 8 to 12% by weight of the co-polymer, the second monomer constitutes 8 to 12% by weight of the co-polymer, with the third monomer constituting the remaining weight of the copolymer. In an example, the first monomer constitutes about 10% by weight of the co-polymer, the second monomer constitutes about 10% by weight of the co-polymer, and with the third monomer constituting the remaining weight of the copolymer. The polymer having ester side groups may be selected from the Bynel® class of monomer, including Bynel® 2022 and Bynel® 2002, which are available from DuPont®.

The polymer having ester side groups may constitute 1% or more by weight of the total amount of the resin polymers in the first resin, e.g. the total amount of the polymer or polymers having acidic side groups and polymer having ester side groups. The polymer having ester side groups may constitute 5% or more by weight of the total amount of the resin polymers in the first resin, in some examples 8% or more by weight of the total amount of the resin polymers in the first resin, in some examples 10% or more by weight of the total amount of the resin polymers in the first resin, in some examples 15% or more by weight of the total amount of the resin polymers in the first resin, in some examples 20% or more by weight of the total amount of the resin polymers in the first resin, in some examples 25% or more by weight of the total amount of the resin polymers in the first resin, in some examples 30% or more by weight of the total amount of the resin polymers in the first resin, in some examples 35% or more by weight of the total amount of the resin polymers in the first resin. The polymer having ester side groups may constitute from 5% to 50% by weight of the total amount of the resin polymers in the first resin, in some examples 10% to 40% by weight of the total amount of the resin polymers in the first resin, in some examples 15% to 30% by weight of the total amount of the polymers in the first resin.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

In some examples, the first resin, or a polymer of the first resin, may have a melting point in the range of from about 80° C. to about 120° C. In some examples, the melting point of the first resin may be the melting point measured according to ASTM D3418.

In an example, the polymer or polymers of the first resin can be selected from the Nucrel family of toners (e.g. Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX76™, Nucrel 2806™, Bynel 2002, Bynel 2014, and Bynel 2020 (sold by E. I. du PONT)), the Aclyn family of toners (e.g. Aclyn 201, Aclyn 246, Aclyn 285, and Aclyn 295), and the Lotader family of toners (e.g. Lotader 2210, Lotader, 3430, and Lotader 8200 (sold by Arkema)).

In some examples, the pigment constitutes a certain wt %, e.g. from 1 wt %, to 60 wt % of the solids of the LEP ink, and the remaining wt % of the solids of the LEP ink is formed by the resin and, in some examples, any other additives that are present. The other additives may constitute 10 wt % or less of the solids of the LEP ink, in some examples 5 wt % or less of the solids of the LEP ink, in some examples 3 wt % or less of the solids of the LEP ink. In some examples, the resin may constitute 5% to 99% by weight of the solids in the LEP ink, in some examples 50% to 90% by weight of the solids of the LEP ink, in some examples 70% to 90% by weight of the solids of the LEP ink. The remaining wt % of the solids in the ink composition may be a pigment and, in some examples, any other additives that may be present.

Carrier Liquid

In some examples, a LEP ink described herein comprises polymer resin (first resin) coated pigment particles, or polymer resin (first resin) particles, which are formed in and/or dispersed in a carrier fluid or carrier liquid. Before application to the print substrate in an LEP printing process the LEP ink composition may be in liquid form; and may comprise a carrier liquid in which is suspended particles comprises a first resin or pigment particles coated with a first resin.

Generally, the carrier liquid acts as a reaction solvent in preparing the first resin coated pigment particles, and can also act as a dispersing medium for the other components in the resulting LEP ink. In some examples, the carrier liquid is a liquid which does not dissolve the first resin at room temperature. In some examples, the carrier liquid is a liquid which dissolves the first resin at elevated temperatures. For example, the first resin may be soluble in the carrier liquid when heated to a temperature of at least 80° C., for example 90° C., for example 100° C., for example 110° C., for example 120° C. For example, the carrier liquid can comprise or be a hydrocarbon, silicone oil, vegetable oil, etc. The carrier liquid can include an insulating, non-polar, non-aqueous liquid that can be used as a medium for particles of the first resin of pigment particles coated with the first resin. The carrier liquid can include compounds that have a resistivity in excess of about $10^9$ ohm-cm. The carrier liquid may have a dielectric constant below about 5, in some examples below about 3. The carrier liquid can include hydrocarbons. The hydrocarbon can include an aliphatic hydrocarbon, an isomerized aliphatic hydrocarbon, branched chain aliphatic hydrocarbons, aromatic hydrocarbons, and combinations thereof. Examples of the carrier liquids include aliphatic hydrocarbons, isoparaffinic compounds, paraffinic compounds, dearomatized hydrocarbon compounds, and the like. In particular, the carrier liquids can include, for example, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-S™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

Before printing, the carrier liquid can constitute about 20% to 99.5% by weight of a LEP ink, in some examples 50% to 99.5% by weight of a LEP ink. Before printing, the carrier liquid may constitute about 40 to 90% by weight of a LEP ink. Before printing, the carrier liquid may constitute about 60% to 80% by weight of a LEP ink. Before printing, the carrier liquid may constitute about 90% to 99.5% by weight of a LEP ink, in some examples 95% to 99% by weight of a LEP ink.

A LEP ink, when printed on a print substrate may be substantially free from carrier liquid. In an LEP printing process and/or afterwards, the carrier liquid may be removed, e.g. by an electrophoresis processes during printing and/or evaporation, such that substantially just solids are transferred to the print substrate. Substantially free from carrier liquid may indicate that the LEP ink printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, the LEP ink printed on a print substrate is free from carrier liquid.

Charge Director and Charge Adjuvant

A liquid electrophotographic composition and/or the LEP ink printed on the print substrate can comprise a charge director. A charge director can be added to a LEP ink to impart a charge of a desired polarity and/or maintain sufficient electrostatic charge on the particles of a LEP ink. The charge director may comprise ionic compounds, including, for example, metal salts of fatty acids, metal salts of sulfosuccinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, for example, barium, sodium, calcium, and aluminium salts of sulfonic acid. The sulfonic acids may include alkyl sulfonic acids, aryl sulfonic acids, and sulfonic acids of alkyl succinates (e.g. see WO 2007/130069). The charge director can impart a negative charge or a positive charge on the resin-containing particles of a LEP ink.

The charge director can comprise a sulfosuccinate moiety of the general formula: $[R_a—O—C(O)CH_2CH(SO_3^-)C(O)—O—R_b]$, where each of $R_a$ and $R_b$ is an alkyl group. In some examples, the charge director comprises nanoparticles of a simple salt and a sulfosuccinate salt of the general formula $MA_n$, wherein M is a metal, n is the valence of M, and A is an ion of the general formula $[R_a—O—C(O)CH_2CH(SO_3^-)C(O)—O—R_b]$, where each of $R_a$ and $R_b$ is an alkyl group, or other charge directors as found in WO2007130069, which is incorporation herein by reference in its entirety. As described in WO2007130069, the sulfosuccinate salt of the general formula $MA_n$ is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 200 nm or less, in some examples 2 nm or more. As described in WO2007130069, simple salts are salts that do not form micelles by themselves, although they may form a core for micelles with a micelle forming salt. The ions constructing the simple salts are all hydrophilic. The simple salt may comprise a cation selected from Mg, Ca, Ba, $NH_4$, tert-butyl ammonium, $Li^+$, and $Al^{+3}$, or from any sub-group thereof. The simple salt may comprise an anion selected from $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO^{4-}$, and $TiO_3^{4-}$, or from any sub-group thereof. The simple salt may be selected from $CaCO_3$, $Ba_2TiO_3$, $Al_2(SO_4)$, $A1(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. The charge director may further comprise basic barium petronate (BBP).

In the formula $[R_a—O—C(O)CH_2CH(SO_3^-)C(O)—O—R_b]$, in some examples, each of $R_a$ and $R_b$ is an aliphatic alkyl group. In some examples, each of $R_a$ and $R_b$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_a$ and $R_b$ are the same. In some examples, at least one of $R_a$ and $R_b$ is $C_{13}H_{27}$. In some examples, M is Na, K, Cs, Ca, or Ba. The formula $[R_a—O—C(O)CH_2CH(SO_3^-)C(O)—O—R_b]$ and/or the formula $MA_n$ may be as defined in any part of WO2007130069.

The charge director may comprise (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In a LEP, the charge director can constitute about 0.001% to 20%, in some examples 0.01 to 20% by weight, in some examples 0.01 to 10% by weight, in some examples 0.01 to 1% by weight of the solids of a LEP ink and/or LEP ink printed on the print substrate. The charge director can constitute about 0.001 to 0.15% by weight of the solids of a liquid electrophotographic ink and/or LEP ink printed on the print substrate, in some examples 0.001 to 0.15%, in some examples 0.001 to 0.02% by weight of the solids of a liquid electrophotographic ink composition and/or LEP ink printed on the print substrate. In some examples, a charge director imparts a negative charge on a LEP ink. The particle conductivity may range from 50 to 500 pmho/cm, in some examples from 200-350 pmho/cm.

A liquid electrophotographic ink composition and/or LEP ink printed on the print substrate can include a charge adjuvant. A charge adjuvant may be present with a charge director, and may be different to the charge director, and act to increase and/or stabilise the charge on particles, e.g. first resin-containing particles, of an LEP ink. The charge adjuvant can include barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminium di and/or tristearate and/or aluminium di and/or tripalmitate.

The charge adjuvant can constitute about 0.1 to 5% by weight of the solids of a liquid electrophotographic ink composition and/or LEP ink printed on the print substrate. The charge adjuvant can constitute about 0.5 to 4% by weight of the solids of a liquid electrophotographic ink composition and/or LEP ink on the print substrate. The charge adjuvant can constitute about 1 to 3% by weight of the solids of a liquid electrophotographic ink composition and/or LEP ink printed on the print substrate.

Other Additives

In some examples, a LEP ink may include an additive or a plurality of additives. The additive or plurality of additives may be added at any stage of the method. The additive or plurality of additives may be selected from a wax, a surfactant, biocides, organic solvents, viscosity modifiers, materials for pH adjustment, sequestering agents, preservatives, compatibility additives, emulsifiers and the like. The wax may be an incompatible wax. As used herein, "incompatible wax" may refer to a wax that is incompatible with the first resin. Specifically, the wax phase separates from the resin phase upon the cooling of the first resin fused mixture on a print substrate during and after the transfer of the ink film to the print substrate, e.g. from an intermediate transfer member, which may be a heated blanket.

Dry Electrophotographic (DEP) Toner

The DEP toner (also referred to herein as a dry electrostatic toner) comprises a second resin. The DEP toner may further comprise an additive such as a charge control agent, wax, surfactant, an additive for improving anti-caking and/or fluidity properties of the DEP toner, combinations thereof, and the like.

The DEP toner lacks a carrier liquid, for example lacks a carrier liquid as described above in relation to the LEP ink. For example, the DEP toner may be described as lacking a carrier liquid, for example lacking a carrier liquid as described above in relation to the LEP ink.

The DEP toner may be in the form of flowable particles, the particles comprising the second resin.

The DEP toner may comprise toner particles comprising the second resin. In some examples, the DEP toner particles may also comprise a colorant or a pigment. In some examples, the DEP toner particles may comprise an additive such as a charge control agent, wax, surfactant, an additive for improving anti-caking and/or fluidity properties of the dry electrophotographic toner, combinations thereof, and the like.

In some examples, the DEP toner particles may have a median particle size or $d_{50}$ of greater than 2 μm, in some examples greater than 4 μm, in some examples greater than 5 μm in some examples greater than 8 μm.

In some examples, the DEP toner particles may have a median particle size or $d_{50}$ of up to about 20 μm, in some examples up to about 16 μm.

In some examples, the DEP toner particles may have a median particle size or $d_{50}$ in the range of 2 to 20 μm, in some examples 5 to 16 μm.

Unless otherwise stated, the particle size of the DEP toner particles is determined using laser diffraction on a Malvern Mastersizer 2000 according to the standard procedure as described in the operating manual.

In some examples, the DEP toner lacks a colorant or pigment. In some examples, the DEP toner is substantially transparent when printed. For example, the transparent dry DEP toner may be any transparent DEP toner standardly used, such as "Clear Dry Ink Toner transparent" from Xerox.

In some examples, the DEP toner may be a substantially colorless, clear or transparent composition substantially free from pigment. In examples in which the DEP toner is substantially free from pigment, the DEP toner may be used as a varnish, a protective layer, a gloss, a gloss inhibitor and/or an adhesive in the methods described herein without contributing a further subtractive effect on the CMYK inks, for example CMYK LEP inks, that would substantially affect the color of an underprinted colored image, for example a LEP colored image.

As used herein, "substantially free from pigment" is used to describe a DEP toner in which less than 5 wt % of the DEP toner is made up of colorant or pigment, in some examples less than 3 wt. %, in some examples less than 1 wt. %, in some examples less than 0.5 wt %, in some examples less than 0.1 wt %, in some examples less than 0.05 wt %, in some examples less than 0.01 wt % of the DEP toner is made up of colorant or pigment.

In some examples, the DEP toner, either before or after having been printed on a print substrate, may include a colorant or pigment. A DEP toner may include a colorant or pigment.

The DEP toner may include a colorant or pigment listed above as a colorant or pigment for a LEP ink.

In some examples, in the methods and related aspects described herein the DEP toner may be printed as a DEP toner image on the print substrate and a LEP ink image may be printed onto the DEP toner image such that a printed substrate on which the LEP ink image is disposed on the DEP toner image is formed, i.e. the LEP ink image is underprinted with a DEP toner image. In some examples, in such methods and related aspects, the DEP toner may be a transparent DEP toner. In some examples, in such methods and related aspects, the DEP toner may be coloured DEP toner, e.g. a white DEP toner, for example a DEP toner comprising a white colorant, or white pigment, for example a white pigment particle. For example, a white dry electrophotographic toner may be any white dry electrophotographic toner standardly used such as White Toner from OKI.

Second Resin

The DEP toner includes a second resin, which may be a thermoplastic resin. A thermoplastic polymer is sometimes referred to as a thermoplastic resin. In some examples, the second resin of the DEP toner is different from the first resin of the LEP ink.

The second resin may include a polymer, in some examples a thermoplastic polymer. In some examples, the second resin may comprise any binder resin suitable for use in dry electrophotographic toners. For example, the second resin may comprise polyester resins, polyurethane resins, polystyrenes, vinyl resins, polyol resins, epoxy resins, polyamide resins, polyimide resins, silicon resins, phenol resins, melamine resins, aniline resins, ionomer resins, polycarbonate resins, polyethylenes, polypropylenes, styrene acrylate copolymers, styrene butadiene copolymers, styrene acrylonitrile copolymers, or styrene-maleic anhydride copolymers. In some examples, the second resin may comprise polyester resins, polyurethane resins, polystyrenes, polyethylenes, polypropylenes, styrene acrylate copolymers, styrene butadiene copolymers, styrene acrylonitrile copolymers, or styrene-maleic anhydride copolymers. In some examples, the second resin may comprise styrene acrylate copolymers, styrene butadiene copolymers, polyesters or combinations thereof.

In some examples, the second resin has a melting point in the range of 80° C. to about 150° C. In some examples, the melting point of the second resin may be the melting point measured according to ASTM D3418.

In some examples, the second resin has a glass transition temperature in the range of from about 50° C. to about 85° C., in some examples about 55° C. to about 85° C., in some examples, 55° C. to about 70° C. The glass transition temperature may be determined according to ASTM E1356.

In some examples, the first resin and the second resin are different.

Additives

The dry electrophotographic toner may comprise an additive such as a charge control agent, release agent such as wax, surfactant, inorganic fine particles such as $SiO_2$ and the like.

In some examples, the DEP toner comprises a wax, for example as a release agent. In some examples, the DEP toner comprises wax in an amount from about 0.1 to about 40 wt. % by total weight of the DEP toner, in some examples from about 1 to about 10 wt. %, in some examples from about 3 to about 30 wt. %.

In some examples, the DEP toner may comprise any suitable wax. In some examples, the DEP toner comprises a wax having a melting point in the range of from about 40° C. to about 160° C., in some examples 50° C. to about 120° C., in some examples 60° C. to about 100° C., in some examples 60° C. to about 90° C., in some examples 65° C. to about 95° C.

In some examples, the DEP toner comprises a was having a melt viscosity of 5 to 1000 cps, in some examples 5 to 500 cps, in some examples 10 to 100 cps at a temperature higher than 20° C. than the melting point thereof.

In some examples, the DEP toner comprises a wax selected from polyolefin wax, e.g. polyethylene wax or polypropylene wax; long chain hydrocarbon wax such as paraffin wax; carbonyl group-containing wax; and microcrystalline waxes.

The additives listed above may, in some examples, not constitute a colorant or pigment for the purposes of the DEP toner described herein.

Print Substrate

The print substrate may be any suitable substrate. The print substrate may be any suitable substrate capable of having an image printed thereon. The print substrate may include a material selected from an organic or inorganic material. The material may include a natural polymeric material, e.g. cellulose. The material may include a synthetic polymeric material, e.g. a polymer formed from alkylene monomers, including, for example, polyethylene and polypropylene, and co-polymers such as styrene-polybutadiene. The polypropylene may, in some examples, be biaxial orientated polypropylene. The material may include a metal, which may be in sheet form. The metal may be selected from or made from, for instance, aluminium (Al), silver (Ag), tin (Sn), copper (Cu), mixtures thereof. In an example, the substrate includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print. In some examples, a primer may be coated onto the print substrate, before the LEP ink is printed onto the print substrate. In some examples, the print substrate is a transparent print substrate, for example the print substrate may be formed from a transparent material such as a transparent polymeric material, e.g. a polymer formed from alkylene monomers, including, for example, polyethylene and polypropylene, and co-polymers such as styrene-polybutadiene.

Electrophotographic Printing Process

Described herein is an electrophotographic printing process. The process may comprise liquid electrophotographically printing a liquid electrophotographic (LEP) ink image and dry electrophotographically printing a dry electrophotographic (DEP) toner on to the same print substrate, such that one of the LEP ink image and the DEP toner image is disposed on the other of the LEP ink image and the DEP toner image on the print substrate.

In some examples, the process may comprise:

- providing a liquid electrophotographic (LEP) ink comprising a first resin, a pigment and a carrier liquid;
- providing a dry electrophotographic (DEP) toner comprising a second resin;
- providing a print substrate;
- liquid electrophotographically printing a LEP ink image on the print substrate; and
- dry electrophotographically printing a DEP toner image on the print substrate.

In some examples, liquid electrophotographically printing a LEP ink image on a print substrate comprises:

- forming a latent image on a first photoconductive member;
- contacting the LEP ink with the latent image on the first photoconductive member to form a LEP ink image on the first photoconductive member;
- transferring the LEP ink image to the print substrate.

In some examples, transfer of the LEP ink image from the first photoconductive member to the print substrate may be via an intermediate transfer member (ITM). In some examples, the ITM is heatable. In some examples, the ITM is heatable and may be used to evaporate carrier liquid from the LEP ink image, e.g. to form a LEP ink film, on the ITM before transfer of the LEP ink image from the ITM to the print substrate (in some examples, transfer of the LEP ink image is to the print substrate on which a DEP toner image is already disposed such that the LEP ink image is disposed on the DEP toner image disposed on the print substrate).

In some examples, dry electrophotographically printing a DEP toner image on a print substrate comprises:

- forming a latent image on a second photoconductive member;
- contacting the DEP toner with the latent image on the second photoconductive member to form a DEP toner image on the second photoconductive member; and transferring the DEP toner image to the print substrate.

In some examples, dry electrophotographically printing a DEP toner image on a print substrate (in some examples a print substrate on which a LEP ink image is already disposed such that the DEP toner image is disposed on the LEP ink image disposed on the print substrate) comprises fusing the DEP toner image on the print substrate. In some examples, fusing the DEP toner image on the print substrate comprises heating the DEP toner image on the print substrate, for example fusing the DEP toner image on the print substrate may comprise fusing at a temperature in the range of about 80° C. to about 200° C.

Also described herein is a process comprising:

- providing a liquid electrophotographic (LEP) ink comprising a first resin, a pigment and a carrier liquid;
- providing a dry electrophotographic (DEP) toner comprising a second resin;
- providing a print substrate;
- forming a latent image on a first photoconductive member;
- contacting the LEP ink with the latent image on the first photoconductive member to form a LEP ink image on the first photoconductive member;
- transferring the LEP ink image to the print substrate;
- forming a latent image on a second photoconductive member;
- contacting the DEP toner with the latent image on the second photoconductive member to form a DEP toner image on the second photoconductive member; and
- transferring the DEP toner image to the print substrate.

The electrophotographic printing process may comprise liquid electrophotographically printing a LEP ink image onto a print substrate and dry electrophotographically printing a DEP toner image onto the same print substrate such that the DEP toner image is disposed on the LEP ink image disposed on the print substrate or the LEP ink image is disposed on the DEP toner image on the print substrate.

Electrophotographically printing a LEP ink image on a print substrate may comprise forming a latent image on a first photoconductive member and contacting the LEP ink with the latent image on the first photoconductive member to form a LEP ink image on the first photoconductive member. The LEP ink image may then be transferred to the print substrate to form a LEP ink image on the print substrate.

In some examples, the LEP ink image may be a single coloured or a multi-coloured image. Multi-coloured LEP ink images may be formed using single-shot or multi-shot processes.

In some examples, electrophotographically printing a LEP ink image on a print substrate comprises transferring the LEP ink image form a first photoconductive member to the print substrate via an intermediate transfer member (ITM). In some examples, electrophotographically printing a LEP ink image on a print substrate comprises removing, e.g. evaporating, carrier liquid from the LEP ink image before transferring the LEP ink image to the print substrate. In some examples evaporation of carrier liquid from the LEP ink image may take place on the ITM. In some examples, the process comprises heating the LEP ink image, e.g. on an ITM, at a temperature in the range of 80 to 120° C., for example to evaporate a carrier liquid from the LEP ink image and form a LEP ink image film to be transferred to the print substrate. In some examples, the LEP ink image may be heated on an intermediate transfer member to form a LEP ink image film before being transferred to a print substrate.

A liquid electrophotographic ink may be printed onto a print substrate in a liquid electrophotographic or electrostatic printing process. Examples of suitable liquid electrophotographic or electrostatic printing equipment are the HP Indigo digital presses, e.g the HP Indigo 2000, 3000, 4000, 5000, 6000, 7000, 10000, 20000 and 30000 series presses.

Dry electrophotographically printing a DEP toner image on a print substrate may comprise forming a latent image on a second photoconductive member and contacting the DEP toner with the latent image on the second photoconductive member to form a DEP toner image on the second photoconductive member. The DEP toner image may then be transferred to the print substrate to form a DEP toner image on the print substrate.

In some examples, electrophotographically printing a DEP toner image on a print substrate comprises fusing the DEP toner image. In some examples, the DEP toner image may be fused at a temperature of greater than 80° C., in some examples at a temperature greater than 100° C., in some examples at a temperature greater than 120° C., in some examples at a temperature in the range of 80-200° C., in some examples 120-200° C. In some examples, a DEP toner image may be transferred from a photoconductive member to a print substrate via an intermediate transfer member. In some examples, the DEP toner image may undergo fusing on the print substrate, e.g. after transfer to the print substrate.

A dry electrophotographic toner may be printed onto a print substrate in a dry electrophotographic or electrostatic printing process using a dry electrophotographic or electrostatic printing apparatus. Examples of suitable dry electrophotographic or electrostatic printing equipment are the Xerox printing presses, e.g. the Xerox Color 1000 Press.

In some examples, the DEP toner image may be dry electrophotographically printed on a LEP ink image disposed on the print substrate such that the DEP toner image is disposed on the LEP ink image on the print substrate. In some examples, the process comprises liquid electrophotographically printing a further LEP ink image on the DEP toner image disposed on the LEP ink image on the print substrate.

In some examples, the LEP ink image may be liquid electrophotographically printed on a DEP ink image disposed on the print substrate such that the LEP ink image is disposed on the DEP toner image on the print substrate. In some examples, the process comprises dry electrophotographically printing a further DEP ink image on the LEP ink image.

In some examples, the process may comprise printing still further DEP ink image and/or LEP ink images on the print substrate.

The electrophotographic printing process may comprise printing a print substrate with a DEP toner image and a LEP ink image using the electrophotographic printing apparatus described herein.

In some examples, the printing process comprises forming a LEP ink image on a print substrate and then forming a DEP toner image, e.g. a transparent DEP toner image, on the LEP ink image disposed on the print substrate.

In some examples, the printing process comprises forming a LEP ink image on a print substrate and then forming a DEP toner image, e.g. a pigmented DEP toner image, on the LEP ink image disposed on the print substrate.

In some examples, the printing process comprises forming a DEP toner image, for example a pigmented (i.e. coloured), e.g. white, DEP toner image, on a print substrate and then forming a LEP ink image on the DEP toner image disposed on the print substrate.

In some examples, the printing process comprises first forming a first DEP toner image, for example a white DEP toner image, on a print substrate and then forming a LEP ink image on the first DEP toner image disposed on the print substrate before forming a second DEP toner image, e.g. a transparent DEP toner image, on the LEP ink image disposed on the first DEP toner image disposed on the print substrate. A second DEP toner image may be formed on the LEP ink image disposed on the first DEP toner image disposed on the print substrate by forming a latent image on a third photoconductive member, contacting a second DEP electrophotographic toner with the latent image on the third photoconductive member to form a second DEP toner image on the third photoconductive member, and transferring the second DEP toner image to the print substrate such that the second DEP toner image is disposed on the LEP ink image disposed on the first DEP toner image disposed on the print substrate. In some examples, the second photoconductive member may be used as the third photoconductive member, i.e. the same DEP printing station, e.g. dry electrostatic printing press, may be used to form the first DEP toner image and the second DEP toner image. In some examples, the second and third photoconductive members are different photoconductive members, e.g. different DEP printing presses may be used to form each of the first DEP toner image and the second DEP toner image. The first and second DEP electrophotographic toners may be the same, e.g. both transparent dry electrophotographic toners, or different, e.g. different colored, or one colored and one transparent, DEP toners.

In some examples, the printing process comprises first forming a first LEP ink image on a print substrate and then forming a DEP toner image on the first LEP ink image disposed on the print substrate before forming a second LEP ink image on the DEP toner image disposed on the first LEP ink image disposed on the print substrate. A second LEP ink image may be formed on the DEP toner image disposed on the first LEP ink image disposed on the print substrate by forming a latent image on a fourth photoconductive member, contacting a LEP ink with the latent image on the fourth photoconductive member to form a second LEP ink image on the fourth photoconductive member, and transferring the second LEP ink image to the print substrate such that the second LEP ink image is disposed on the DEP toner image disposed on the first LEP ink image disposed on the print substrate. In some examples, the first photoconductive member may be used as the fourth photoconductive member, i.e. the same LEP printing press may be used to form the first LEP ink image and the second LEP ink image. In some examples, the first and fourth photoconductive members are different photoconductive members, e.g. different LEP printing presses may be used to form each of the first LEP ink image and the second LEP ink image. In some examples, the first LEP ink image may be a single coloured or a multi-coloured image. In some examples, the second ink image may be a single coloured or a multi-coloured image.

In some examples, the process comprises controlling the position of the print substrate during liquid electrophotographically printing a LEP ink image on the print substrate and/or controlling the position of the print substrate during dry electrophotographically printing a DEP toner image on the print substrate. In some examples, the process comprises controlling the position of the print substrate in an electrophotographic printing apparatus. In some examples, the process comprises, controlling timing of liquid electrophotographic printing in relation to the position of the print substrate within an electrophotographic printing apparatus. In some examples, the process comprises, controlling timing of dry electrophotographic printing in relation to the position of the print substrate within an electrophotographic printing apparatus.

In some examples, the process comprises controlling the position of the print substrate as the LEP ink image is transferred to the print substrate. In some examples, the process comprises controlling the position of the print substrate as the DEP toner image is transferred to the print substrate. In some examples, the process comprises controlling the position of the print substrate as the LEP ink image is transferred to the print substrate and also controlling the position of the print substrate as the DEP toner image is transferred to the print substrate.

In some examples, the process comprises printing a LEP ink image to a print substrate at a LEP printing station and printing a DEP toner image to the print substrate at a dry electrophotographic printing station.

In some examples, the process comprises synchronising printing of the LEP ink image and printing of the DEP toner image. In some examples, the printing of the LEP ink image and the printing of the DEP toner image may be synchronised such that the positions of the LEP ink image and the DEP toner image printed on the print substrate are controlled with respect to one another. In some examples, the printing of the LEP ink image and the printing of the DEP toner image may be synchronised such that the order of printing of the DEP toner image and the printing of the LEP ink image on the print substrate are controlled with respect to one another.

In some examples, a LEP ink image may be transferred to the print substrate from a photoconductive member via an intermediate transfer member (ITM). In some examples, the ITM is heatable.

In some examples, the process comprises fusing the DEP toner image on the print substrate. The DEP toner image may be fused under conditions of elevated temperature and/or pressure. In some examples, the DEP toner image may be fused at a temperature in the range of 80-200° C. In some examples, the DEP toner image may be exposed to conditions of elevated temperature for from about 0.01 s to about 1 s.

Electrophotographic Printing Apparatus

Described herein is an electrophotographic printing apparatus to print a DEP toner image and a LEP ink image on a print substrate, the electrophotographic printing apparatus comprising:

- a LEP printing station comprising a reservoir for receiving a LEP ink and a first photoconductive member having a surface on which a first latent image can be created;
- a DEP printing station comprising a reservoir for receiving a DEP toner and a second photoconductive member having a surface on which a second latent image can be created; and
- a controller in communication with the LEP printing station and the DEP printing station to control the position of the LEP ink image and the DEP toner image on the print substrate with respect to one another.

In some examples, the DEP toner image is dry electrophotographically printed on the LEP ink image disposed on the print substrate such that the DEP toner image is disposed on the LEP ink image on the print substrate or the LEP ink image is liquid electrophotographically printed on the DEP ink image disposed on the print substrate such that the LEP ink image is disposed on the DEP toner image on the print substrate.

FIG. 1*a* is a schematic diagram of an electrophotographic printing apparatus 1 to print a DEP toner image and a LEP ink image on a print substrate. In this example, the electrophotographic printing apparatus 1 comprises a LEP printing station 2 and a DEP printing station 4. The LEP printing station 2 comprises a reservoir 6 for receiving a LEP ink and a first photoconductive member 8 having a surface on which a first latent image can be created. The DEP printing station 4 comprises a reservoir 10 for receiving a DEP toner and a second photoconductive member 12 having a surface on which a second latent image can be created. In this example, the electrophotographic printing apparatus 1 also comprises a controller 14 in communication with the LEP printing station 2 and the DEP printing station 4 to control the position of the LEP ink image and the DEP toner image on the print substrate with respect to one another.

In the LEP printing station 2 a first latent electrostatic image (a latent electrostatic image is an electrostatic charge pattern representing the image to be printed) may be created on the first photoconductive member 8. In some examples, the first photoconductive member has a cylindrical shape. A LEP ink which may be contained in the reservoir 6 may be transferred to the first photoconductive member 8 by virtue of an appropriate electrostatic potential applied to the LEP ink in the reservoir 6, for example an appropriate electrostatic potential to charge ink particles contained in the LEP ink such that charged ink particles are transferred from the reservoir 6 to the first latent electrostatic image on the first photoconductive member 8. The photoconductive member 8 then has a LEP ink image on its surface. The LEP ink image may then be transferred to a print substrate, in some examples via an intermediate transfer member.

In some examples, the LEP printing station 2 comprises an intermediate transfer member. In some examples, the intermediate transfer member has a cylindrical shape. In some examples, the intermediate transfer member is heatable.

In the DEP printing station 4 a second latent electrostatic image (a latent electrostatic image is an electrostatic charge pattern representing the image to be printed) may be created on the second photoconductive member 12. A DEP toner which may be contained in the reservoir 10 may be transferred to the second photoconductive member 12 by virtue of an appropriate electrostatic potential applied to the DEP toner in the reservoir 10, for example an appropriate electrostatic potential to charge toner particles contained in the DEP toner such that charged toner particles are transferred from the reservoir 10 to the second latent electrostatic image on the second photoconductive member 12. In some examples, the second photoconductive member has a cylindrical shape. The photoconductive member 12 then has a DEP toner image on its surface. The DEP toner image may then be transferred to a print substrate, in some examples via an intermediate transfer member.

Figure 1B:
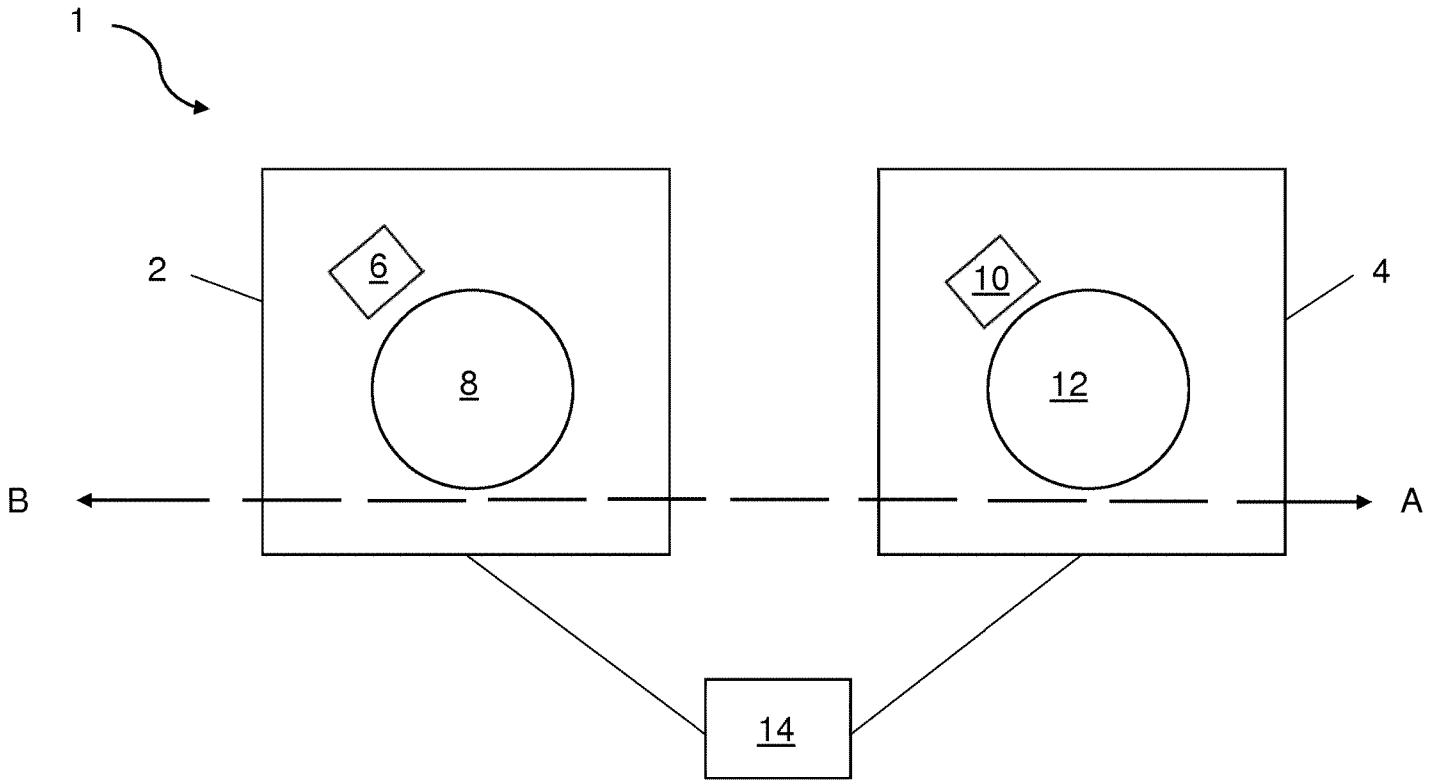
FIG. 1*b* is a schematic diagram of an electrophotographic printing apparatus.

FIG. 1*b* shows the electrophotographic printing apparatus 1 of FIG. 1*a* and indicates the directions A and B in which a print substrate may be moved through the electrophotographic printing apparatus 1.

In some examples, a print substrate may first enter the LEP printing station 2 where a LEP ink image may be transferred to the print substrate. The print substrate may then be transferred from the LEP printing station 2 in direction A to the DEP printing station 4 for a DEP toner image, e.g. a transparent DEP toner image, to be transferred to the print substrate such that the DEP toner image is disposed on the LEP ink image disposed on the print substrate.

In some examples, a print substrate may first enter the DEP printing station 4, where a DEP toner image may be transferred to the print substrate. The print substrate may then be transferred from the DEP printing station 4 in direction B to the LEP printing station 2 for a LEP image to be transferred to the print substrate such that the LEP image is disposed on the DEP toner image disposed on the print substrate.

In some examples, the DEP toner image may be a transparent DEP toner image. In some examples, the DEP toner image may be a pigmented DEP toner image (i.e. a DEP toner image formed from a DEP toner comprising a pigment), e.g. a coloured DEP toner image, e.g. a white DEP toner image or a metallic DEP toner image.

In some examples, the controller 14 is in communication with the LEP printing station 2 and the DEP printing station 4 to control the position to which the LEP ink image and the DEP toner image are transferred to the print substrate with respect to one another.

In some examples, the controller 14 synchronises the printing of the LEP ink image onto the print substrate at the LEP printing station 2 and the printing of the DEP toner image onto the print substrate at the DEP printing station 4 such that the positions of the LEP ink image and the DEP toner image printed on the print substrate are controlled with respect to one another. In some examples, the controller 14 detects the location of a print substrate within the electrophotographic printing apparatus 1. In some examples, the controller 14 controls the location of a print substrate within the electrophotographic printing apparatus 1. In some examples, the controller 14 activates transfer of the print substrate between the LEP printing station 2 and the DEP printing station 4. In some examples, the controller 14 activates printing of a LEP ink onto the print substrate at the LEP printing station 2. In some examples, the controller 14 activates printing of a DEP ink onto the print substrate at the DEP printing station 4.

In some examples, in use, a print substrate may be transferred between the LEP printing station 2 and the DEP printing station 4 a plurality of times. In some examples, a print substrate may make multiple passes through the LEP print station 2 and/or the DEP printing station 4.

In some examples a print substrate may enter the electrophotographic printing apparatus 1 and be transferred to the LEP printing station 2 where a LEP ink image is transferred to the print substrate. The print substrate may then be transferred to the DEP printing station 4 where a DEP toner image is transferred to the print substrate. The print substrate may then be returned to the LEP printing station 2 for a second LEP ink image to be transferred to the print substrate such that the DEP toner image is disposed between the first and second LEP ink images on the print substrate.

In some examples a print substrate may enter the electrophotographic printing apparatus 1 and be transferred to the DEP printing station 4 where a DEP toner image is transferred to the print substrate. The print substrate may then be transferred to the LEP printing station 2 where a LEP ink image is transferred to the print substrate. The print substrate may then be returned to the DEP printing station 4 for a second DEP toner image to be transferred to the print substrate such that the LEP ink image is disposed between the first and second DEP toner images on the print substrate.

In some examples, the electrophotographic printing apparatus may comprise an additional LEP printing station and/or an additional DEP electrostatic printing station.

Printed Substrate

Described herein is a printed substrate comprising:

a print substrate;

a liquid electrophotographically printed LEP ink layer; and a dry electrophotographically printed DEP toner layer.

In some examples, the printed substrate comprises:

a print substrate;

a liquid electrophotographically printed LEP ink layer comprising a first resin and a pigment; and a dry electrophotographically printed DEP toner layer comprising a second resin.

In some examples, the dry electrophotographically printed DEP toner layer has a thickness greater than the thickness of the liquid electrophotographically printed LEP ink layer.

In some examples, the dry electrophotographically printed DEP toner layer is disposed on the liquid electrophotographically printed LEP ink layer which is disposed on the print substrate. In some examples, the liquid electrophotographically printed LEP ink layer is disposed on the dry electrophotographically printed DEP toner layer which is disposed on the print substrate.

Figure 2A:
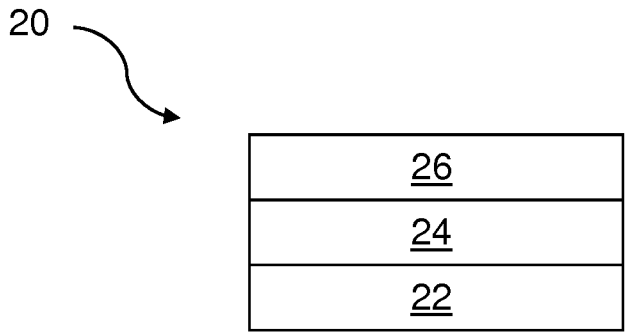
FIG. 2*a* is a schematic diagram of a printed substrate.
Figure 2B:
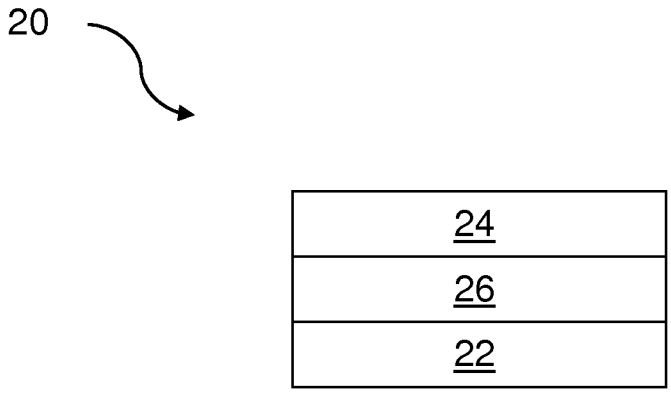
FIG. 2*b* is a schematic diagram of a printed substrate.

FIGS. 2*a* and 2*b* both illustrate a schematic diagram of a printed substrate as described herein.

FIG. 2*a* shows a printed substrate 20 comprising a print substrate 22 on which a liquid electrophotographically printed ink layer 24 is disposed and a dry electrophotographically printed DEP toner layer 26 disposed on the liquid electrophotographically printed LEP ink layer 24.

FIG. 2*b* shows a printed substrate 20 comprising a print substrate 22 on which a dry electrostatically printed toner layer 26 is disposed and a liquid electrophotographically printed ink layer 24 disposed on the dry electrostatically printed toner layer 26.

Figure 3A:
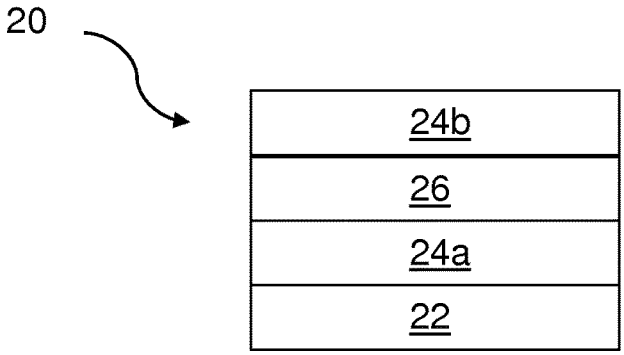
FIG. 3*a* is a schematic diagram of a printed substrate.
Figure 3B:
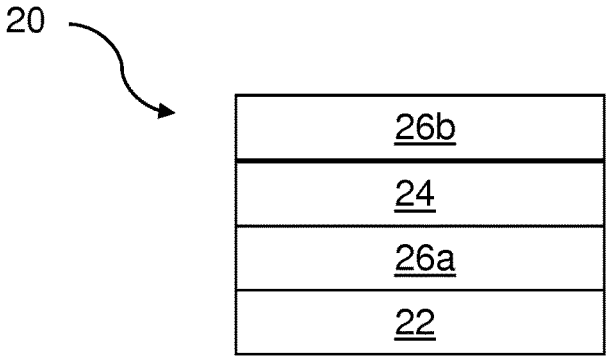
FIG. 3*b* is a schematic diagram of a printed substrate.

FIGS. 3*a* and 3*b* both illustrate a schematic diagram of a printed substrate as described herein. The printed substrates 20 shown in FIGS. 3*a* and 3*b* may be formed by passing a print substrate between a LEP printing station and a DEP printing station a plurality of times.

FIG. 3*a* shows a printed substrate 20 comprising a print substrate 22 on which a first liquid electrophotographically printed ink layer 24*a* is disposed and a dry electrostatically printed toner layer 26 disposed on the first liquid electrophotographically printed ink layer 24*a* and a second liquid electrophotographically printed ink layer 24*b* disposed on the dry electrostatically printed toner layer 26 such that the dry electrostatically printed toner layer 26 is disposed between the first and second liquid electrophotographically printed ink layers 24*a*, 24*b*.

FIG. 3*b* shows a printed substrate 20 comprising a print substrate 22 on which a first dry electrostatically printed toner layer 26*a* is disposed and a liquid electrophotographically printed ink layer 24 disposed on the dry electrophotographically printed toner layer 26*a* and a second dry electrophotographically printed toner layer 26*b* disposed on the liquid electrophotographically printed ink layer 24 such that the liquid electrophotographically printed ink layer 24 is disposed between the first and second dry electrophotographically printed toner layers 26*a*, 26*b*.

In some examples, the liquid electrophotographically printed ink layer comprises a first resin, for example a first resin as described herein. In some examples, the liquid electrophotographically printed ink layer comprising a first resin and a pigment. In some examples, the first resin comprises a copolymer of an alkylene monomer and a monomer selected from acrylic acid and methacrylic acid, for example an ethylene acrylic acid and/or an ethylene methacrylic acid.

In some examples, the liquid electrophotographically printed ink layer has a thickness of less than about 10 μm, in some examples less than about 8 μm, in some examples less than about 5 μm, in some examples less than about 3 μm, in some examples less than about 2 μm, in some examples about 1 μm.

In some examples, the liquid electrophotographically printed ink layer has a thickness of greater than about 0.5 μm, in some examples greater than about 1 μm.

In some examples, the liquid electrophotographically printed ink layer has a thickness in the range of about 0.5 μm to about 10 μm, in some examples in the range of about 0.5 μm to about 5 μm, in some examples in the range of about 0.5 μm to about 3 μm.

In some examples, the dry electrophotographically printed toner layer comprises a second resin, for example a second resin as described herein. In some examples, the second resin may comprise a thermoplastic polymer selected from polyester resins, polyurethane resins, polystyrenes, polyethylenes, polypropylenes, styrene acrylate copolymers, styrene butadiene copolymers, styrene acrylonitrile copolymers, and styrene-maleic anhydride copolymers. In some examples, the second resin may comprise a thermoplastic polymer selected from styrene acrylate copolymer, styrene butadiene copolymer and polyester.

In some examples, the dry electrophotographically printed toner layer is a transparent layer. For example, the dry electrophotographically printed toner layer may be a transparent layer which is disposed on a liquid electrophotographically printed ink layer.

In some examples, the dry electrophotographically printed toner layer comprises a pigment.

In some examples, the dry electrophotographically printed toner layer has a thickness of less than about 30 μm, in some examples less than about 20 μm in some examples less than about 16 μm, in some examples less than about 15 μm.

In some examples, the dry electrophotographically printed toner layer has a thickness of greater than about 2 μm, in some examples greater than about 4 μm, in some examples greater than about 6 μm.

In some examples, the dry electrophotographically printed toner layer has a thickness in the range of about 2 μm to about 30 μm, in some examples 4 μm to about 20 μm, in some examples 4 μm to about 16 μm, in some examples 6 μm to about 15 μm.

EXAMPLES

The following illustrates examples of the methods, apparatus and related aspects described herein. Thus, these examples should not be considered as restricting the present disclosure, but are merely in place to teach how to make examples of the present disclosure. As such, a representative number of methods and related aspects are disclosed herein.

Peeling Test

CMYK single coloured images were liquid electrophotographically printed onto Multifine 130 g/m$^2$ (uncoated paper from StoraEnso) print substrates using 7800 HP Indigo press. The coloured LEP inks used were CMYK ElectroInk® 4.5 (HP Indigo) which contain a first resin being a 4:1 mixture of Nucrel®699:AC-5120 (comprising an ethylene acrylic acid copolymer and an ethylene methacrylic acid copolymer). Reference prints were provided comprising a LEP ink image and no DEP toner image. Printed substrates were also provided comprising the CMYK single coloured images and one layer of a transparent DEP toner printed on top of the LEP ink image as well as printed substrates comprising two layers of DEP toner printed onto of the LEP ink images as recorded in tables 1-3 below.

The DEP toner layers were printed by introducing the LEP ink printed substrates into a Xerox Color 1000 Press to print one or two layers of a transparent DEP toner ("Clear Dry Ink Toner transparent" from Xerox) as details in tables 1-3 below.

The DEP toner thickness was determined by printing 5 layers of the transparent toner on a smooth PET transparency. The thickness of the 5 printed layers was determined by a digital micrometer. The average thickness of a printed transparent layer was determined to be 2.2 microns.

Peeling tests were performed by adhering tape (3M SCOTCH® Magic Tape #230) to the surface of the reference prints and the LEP ink printed substrates printed with one or two layers of transparent dry electrophotographic toner using 1 kg rubber coated roller. The rubber roll was passed 10 times (five double passes) to obtain adhesion between the print being tested and the testing tape. The tape was removed manually from the tested samples. The post printing test was performed for all samples after a predetermined time of 10 minutes. The resistance to peeling was evaluated by comparing the optical density (OD) of the undamaged print to the area where the tape removed some of the printed ink. The OD was determined using a scanner 10000 XL from Epson. The results are shown in Table 1 below.

TABLE 1

| Tested print | OD - ref [%] | OD - One separation transparent DEP toner[%] | OD - Two separations transparent DEP toner [%] |
|---|---|---|---|
| Yellow 100% | 76.19 | 98.11 | 99.44 |
| Magenta 100% | 79.23 | 97.93 | 99.17 |
| Cyan 100% | 80.51 | 98.71 | 99.32 |
| Black 100% | 76.69 | 96.78 | 99.08 |
| Black 400% | 48.28 | 86.21 | 99.30 |

The results in table 1 demonstrate that the adhesion of one layer of the LEP ink to this print substrate is not satisfying and that applying one protective DEP toner layer improved the adhesion. The resistance to peeling of four layers of LEP ink (400%) is dramatically improved when one layer of dry electrophotographically printed DEP transparent toner is printed on top of these four LEP printed layers.

According to table 1, peeling is improved significantly by applying one or two dry electrophotographically printed DEP transparent toner layers onto of the LEP printed layers.

Rub Test

Reference and test printed substrates were prepared as described above for the peeling test except that the print substrate used was Borgo gloss (coated paper) 130 g/m$^2$.

Rub resistance of each of the printed substrates was tested by rubbing the printed sample in a controlled manner with lapping paper 216X from 3M. The samples were rubbed applying 100 double hits by Sutherland® rub tester. The resistance to peeling is evaluated by comparing the OD of the undamaged print to the area where the controlled rub process removed some of the printed ink. The OD was determined using a spectrophotometer color eye XTH from X-Rite. One separation of DEP toner printed on top of the LEP test image was found to provide excellent protection. This improvement of rub resistance is demonstrated in table 2

TABLE 2

| Tested print | OD - ref [%] | OD - One separation transparent DEP toner [%] | OD - Two separations transparent DEP toner [%] |
|---|---|---|---|
| Yellow 100% | 82.03 | 98.39 | 99.64 |
| Magenta 100% | 88.12 | 99.09 | 98.86 |
| Cyan 100% | 96.19 | 102.7 | 100 |
| Black 100% | 72.55 | 97.94 | 97.75 |

Scratch Test

Reference and test prints were obtained by printing multi-coloured YMCK LEP ink images onto print substrates (CONDAT DIGITAL GLOSS 135 gr form Condat, France). The reference print was not printed with a DEP toner image in addition to the LEP ink image. The test prints were dry electrophotographically printed with one or two separations of transparent DEP toner on top of the LEP ink images as noted in Table 3 below.

The reference and test prints were scratched in controlled manner under a load of 50 gr. using Taber® Shear/Scratch Tester model 551. The damage to the test printed samples was evaluated visually by comparing the damaged sample to a non-tested sample.

The test print comprising two separations of the DEP toner (thickness of 4.5 micron) granted the best protection, the LEP ink was hardly scratched. Instead the protective DEP toner layer was scratched.

The mass of printed ink removed by from the reference print together with the visual inspection suggest that the mass, 0.420 milligram scratched off from the reference (non-protected print) is LEP ink.

The LEP ink protected by one separation of DEP toner was scratched. The increase of the mass scratched off from the LEP print, protected by one separation of DEP toner, 0.676 milligram and the visual result suggest that the protective layer and some of the LEP ink was scratched off.

The LEP ink protected by two separations of DEP toner (thickness of 4.5 micron) was almost not scratched. The mass scratched off from the LEP print, protected by two separations of DEP toner, 0.473 milligram and the visual result suggest that the protective layer was scratched off leaving the LEP ink intact.

TABLE 3

| Samples scratched | Mass removed by scratch [microgram] | Remarks |
|---|---|---|
| YMCK ref | 0.420 | ay. of 5 samples |
| YMCK + 1 separation DEP toner | 0.676 | av. of 8 samples |
| YMCK + 2 separation DEP toner | 0.474 | av. of 8 samples |

Without wishing to be bound by theory, it is thought that applying heat and/or pressure to a print substrate printed with a LEP image during transfer of the DEP image on to the LEP image and/or fusing of the DEP image on top of the LEP image on the print substrate may further improve mechanical properties of the LEP image on the print substrate.

Opacity Test

Printed substrates were prepared by printing a white dry electrophotographic toner (White toner from OKI, Japan) on to smooth PET transparencies using a dry electrophotographic printing press (C941 printer from OKI, Japan) to provide a dry electrophotographically printed toner layer on a transparent print substrate. In one example, one separation of dry electrophotographic toner was dry electrophotographically printed onto the print substrate, in another example two separations of dry electrophotographic toner was dry electrophotographically printed onto the print substrate, in another example two separations of dry electrophotographic toner was dry electrophotographically printed onto the print substrate. The opacity of each of the printed substrates was determined using an opacimeter (opacimeter model BNL-3 from Technidyne corporation USA calibrated using a white 100% opaque calibration film). The thickness of the dry electrophotographically printed white toner layers were determined using a digital micrometer. The results are shown in Table 4.

| Number of DEP white toner separations | Thickness (μm) | Opacity (%) |
|---|---|---|
| 1 | 4 | 59.32 |
| 2 | 8 | 74.22 |
| 3 | 12 | 82.8 |

The PET transparencies electrophotographically printed with a dry electrophotographic white toner layer were transferred to a liquid electrostatic printing press (HP Indigo press series 5000) and liquid electrostatically printed with a LEP ink layer (cyan ElectroInk 4.5 from HP Indigo. The LEP ink layer was transferred and fixed successfully on top of the electrophotographically printed DEP white toner layer.

While the methods, apparatus and related aspects have been described with reference to certain examples, it will be appreciated that various modifications, changes, omissions, and substitutions can be made without departing from the spirit and scope of the disclosure. The features of any dependent claim may be combined with the features of any of the other dependent claims or any and/or any of the independent claims.

The invention claimed is:

1. A process comprising:

providing a liquid electrophotographic (LEP) ink comprising a first resin, a pigment and a carrier liquid;

providing a dry electrophotographic (DEP) toner comprising a second resin;

providing a print substrate;

liquid electrophotographically printing a LEP ink image on the print substrate; and dry electrophotographically printing a DEP toner image on the print substrate;

wherein the LEP ink image has a thickness of less than 5 μm and the DEP toner image has a thickness of greater than 2 μm.

2. The process according to claim 1, wherein the DEP toner image is dry electrophotographically printed on the LEP ink image disposed on the print substrate such that the DEP toner image is disposed on the LEP ink image on the print substrate.

3. The process according to claim 1, wherein the LEP ink image is liquid electrophotographically printed on the DEP toner image disposed on the print substrate such that the LEP ink image is disposed on the DEP toner image on the print substrate.

4. The process according to claim 3 comprising dry electrophotographically printing a further DEP toner image on the LEP ink image is disposed on the DEP toner image on the print substrate.

5. The process according to claim 1 comprising fusing the DEP toner image on the print substrate.

6. The process according to claim 1 comprising controlling the position of the print substrate during liquid electrophotographically printing a LEP ink image on the print substrate and/or controlling the position of the print substrate during dry electrophotographically printing a DEP toner image on the print substrate.

7. An electrophotographic printing apparatus to print a DEP toner image and a LEP ink image on a print substrate, the electrophotographic printing apparatus comprising:

a LEP printing station comprising a reservoir for receiving a LEP ink and a first photoconductive member having a surface on which a first latent image having a thickness of less than 5 μm can be created;

a DEP station comprising a reservoir for receiving a DEP toner and a second photoconductive member having a surface on which a second latent image having a thickness of greater than 2 μm can be created; and a controller in communication with the LEP printing station and the DEP printing station to control the position of the LEP ink image and the DEP toner image on the print substrate with respect to one another.

8. The apparatus according to claim 7, wherein the controller controls the location of a print substrate within the electrophotographic printing apparatus.

9. The apparatus according to claim 7, wherein the controller synchronizes printing of a LEP ink image onto the print substrate at the LEP printing station and printing of a DEP toner image onto the print substrate at the DEP printing station.

10. A printed substrate comprising:

a print substrate;

a liquid electrophotographically printed ink layer comprising a first resin and a pigment; and a dry electrophotographically printed toner layer;

wherein the liquid electrophotographically printed ink layer has a thickness of less than 5 μm and the dry electrophotographically printed toner layer has a thickness of greater than 2 μm.

11. The printed substrate according to claim 10, wherein the dry electrophotographically printed toner layer has a thickness greater than the thickness of the liquid electrophotographically printed ink layer.

12. The printed substrate according to claim 10, wherein the dry electrophotographically printed DEP toner layer is disposed on the liquid electrophotographically printed LEP ink layer which is disposed on the print substrate.

13. The printed substrate according to claim 10, wherein the liquid electrophotographically printed LEP ink layer is disposed on the dry electrophotographically printed DEP toner layer which is disposed on the print substrate.

14. The printed substrate according to claim 10, wherein the first resin comprises a copolymer of an alkylene monomer and a monomer selected from acrylic acid and methacrylic acid and the second resin comprises a thermoplastic polymer selected from styrene acrylate copolymer, styrene butadiene copolymer and polyester.

15. The process according to claim 2 further comprising liquid electrophotographically printing a further LEP ink image on the DEP toner image disposed on the LEP ink image on the print substrate.

* * * * *